US006746550B1

(12) United States Patent
Hollinger

(10) Patent No.: US 6,746,550 B1
(45) Date of Patent: Jun. 8, 2004

(54) COMPACTED GRAPHITE CAST IRON ALLOY AND ITS METHOD OF MAKING

(75) Inventor: Bertil Isak Hollinger, Katrineholm (SE)

(73) Assignee: SinterCast AB, Stockholm (SE)

( * ) Notice: Subject to any disclaimer, the term of this patent is extended or adjusted under 35 U.S.C. 154(b) by 0 days.

(21) Appl. No.: 09/720,975

(22) PCT Filed: Jul. 2, 1999

(86) PCT No.: PCT/SE99/01206

§ 371 (c)(1),
(2), (4) Date: Jan. 3, 2001

(87) PCT Pub. No.: WO00/01860

PCT Pub. Date: Jan. 13, 2000

(30) Foreign Application Priority Data

Jul. 3, 1998 (SE) ..... 9802418

(51) Int. Cl.[7] ..... C22C 37/10; C21D 7/00

(52) U.S. Cl. ..... 148/321; 148/544; 148/614; 148/612; 148/543

(58) Field of Search ..... 148/321, 544, 148/614, 543

(56) References Cited

U.S. PATENT DOCUMENTS 6,073,524 A * 6/2000 Weiss et al. ..... 407/35

FOREIGN PATENT DOCUMENTS

| | | | | |
|---|---|---|---|---|
| JP | 55-44560 | | 3/1980 | |
| JP | 55-164056 | | 12/1980 | |
| JP | 58-93854 | | 6/1983 | |
| JP | 58093854 A | * | 6/1983 | ..... C22C/37/04 |

OTHER PUBLICATIONS 60247036 a (mitsui eng & shipbuilding co) Dec. 6, 1985 (abstract) World Patents Index (online). London, U.K.: Derwent Publications, Ltd. (retrieved on Nov. 3, 1999). Retrieved from: EPO WPI Database.DW198604, Accession No. 1986–025012; & JP 60247036 A (Mitsui Zosen KK) Apr. 30, 1986 (abstract). (online) (retrieved on Nov. 3, 1999). Retrieved from: EPO PAJ Databse.

* cited by examiner

*Primary Examiner*—Deborah Yee
(74) *Attorney, Agent, or Firm*—Nixon & Vanderhye P.C.

(57) ABSTRACT

A process for producing a compacted graphite iron (CGI) article, comprising the steps of: (a) providing a CGI base iron having a composition comprising, in weight percentages, about 3.2 to 3.8 total C, 2.8 to 4.0 Si and the balance at least Fe and incidental impurities; (b) treating, controlling and casting the alloy in a manner known per se; (c) allowing the cast component to cool in the mould to a temperature of at least 775° C.; (d) cleaning the casting in a manner known per se and machining the casting to produce a finished article.

8 Claims, No Drawings

COMPACTED GRAPHITE CAST IRON ALLOY AND ITS METHOD OF MAKING

TECHNICAL FIELD

The present invention relates to a process for production of a compacted graphite iron alloy article, which is easy to machine.

BACKGROUND OF THE INVENTION

Compacted Graphite Iron (CGI) is widely recognized as being an excellent material for car and truck cylinder blocks, among other applications. The increased strength, stiffness, fatigue resistance and wear resistance relative to conventional grey cast iron and the common aluminium alloys allows engine designers to increase performance while reducing weight and emissions. However, the improved properties of CGI also make it more difficult to machine.

Conventional machining operations such as milling, drilling, tapping and honing can be successfully performed with CGI, although tool life may be 10–50% lower than that achieved with grey iron. This reduced machinability is generally accepted in lieu of the higher strength castings. However, the tool wear encountered during high speed cylinder boring is not acceptable. The high speed (>600 m/min) boring of cylinder bores uses CBN (cubic boron nitride) or ceramic cutting tools. Although a typical cylinder bore is only about 85 mm in diameter and 95 mm deep, with tool feed rates of 0.20 mm/revolution, the machining tool experiences approximately 125 m of continuous contact with the metal as it spirals down the bore. During this continuous cut, the relatively higher hardness and strength of CGI causes the temperature of the tool to increase and the tool wear to become excessive. Under high speed machining conditions, the tool wear encountered with CGI is approximately twenty times higher than with conventional grey iron. Machining generally accounts for approximately 10% of the total cost of manufacturing a finished engine. Therefore, CGI alloys with improved machinability have been demanded to reduce costs. Indeed, CGI alloys with improved machinability, in particular high speed cylinder bore finishing, are required before CGI can be adopted for high volume (≧100 000 units per year) series production.

Beyond the superior mechanical properties, CGI is approximately 20% harder than grey cast iron when compared at equal pearlite content. Compacted graphite iron also has 1–3% elongation whereas grey iron has effectively no ductility. These factors contribute to altering the chip formation and tool wear mechanisms during machining.

JP 58-93854 discloses a vermicular graphite cast iron, including 3–4% C, 34.5% Si, Mn below 0.3%, P below 0.05%, S below 0.03% and Mg 0.005–0.030%, for use in the manufacturing of exhaust manifolds. The purpose of this composition is to meet the operational criteria of exhaust manifolds, namely elevated temperature fatigue strength and oxidation resistance. Nothing is said about the machinability characteristics of this composition.

There is currently no method available to achieve the needed tool life during high speed cylinder bore finish of CGI. In an attempt to minimize the hardness of CGI and thus improve the machinability of CGI, many development activities have investigated a 70% pearlitic/30% ferritic matrix, although this CGI matrix composition has approximately the same hardness as conventional grey iron. However, the high-speed machinability is not significantly improved relative to fully pearlite CGI. The CGI alloy of the present invention provides a means to overcome the machining problem, which currently prevents the industrial adoption of CGI engine blocks.

DISCLOSURE OF THE INVENTION

The problem to be solved by means of the present invention is to provide a CGI alloy which permits an improved machinability, particularly during high speed cylinder bore finishing, in terms of tool life and chip disposability, compared to conventional CGI alloys.

This problem is solved according to the invention as it is surprisingly found that alloying the CGI with higher than normal silicon contents improves the high speed machinability.

The conventional CGI alloy composition for engine block applications contains 2.0–2.5% silicon. However, at silicon contents between 2.8–4.0% (by weight) the CGI will solidify with a predominantly ferric matrix. The higher silicon content promotes graphite formation thus depleting the matrix of free carbon and preventing the eutectic formation of iron carbide ($Fe_3C$). Additionally, in contrast to normal ferritic irons which are relatively soft and weak and tend to adhere to the cutting tool and or/tear during machining, the high silicon content results in a hard ferrite. The silicon content can be selected to achieve the same hardness range as for conventional grey iron while retaining a fully ferritic matrix. Altematively, the silicon content can be varied to achieve the desired hardness level and range. The free silicon atoms in the iron matrix harden the ferrite by a solid solution mechanism, which maintains strength and wear resistance while providing improved chip removal and improved tool life.

In brief, the composition of the CGI alloy of the present invention essentially comprises, in weight %, about: 3.2 to 3.8 total carbon C; 2.8 to 4.0 silicon Si; 0.005 to 0.025 magnesium Mg; and the balance iron Fe and incidental impurities, wherein Mg may be added separately or in combination, up to 0.025%. The unique aspects of the present invention reside in the fact that the machinability of the alloy is controlled by alloy chemistry. The CGI articles so produced achieve the desired microstructures and properties prior to machining, with no changes required to the conventional machining procedures for grey cast iron.

More preferably, the CGI alloy of the invention comprises essentially, in weight % about: 3.2 to 3.8 total carbon; 2.8 to 4.0 silicon; 0.005 to 0.025 magnesium; up to 0.030 sulphur; up to 0.4 manganese; up to 0.2 copper; trace tin and the balance iron and incidental impurities. Additions of Mg may also be made as specified above.

The silicon content can be selected to achieve the same hardness range as for conventional grey iron while retaining a fully ferric matrix, wherein the alloy comprises 2.8–4.0 weight % silicon as disclosed above.

The present invention is also directed to a process for making a compacted graphite iron (CGI) article, comprising the steps of:

(a) providing a CGI base iron comprising, in weight percentages, about
3.2 to 3.8 total C
2.8 to 4.0 Si and the balance at least Fe and incidental impurities.

(b) treating, controlling and casting the alloy in a manner known per se, (c) allowing the cast component to cool in the mould to a temperature of at least 775° C., prior to shake out (d) cleaning the casting in a manner known per se and machining the casting to produce a finished article.

The invention further relates to a machinable CGI material obtained by the following steps:

(a) providing a CGI base iron having a composition as described above, (b) treating, controlling and casting the alloy in a manner known per se, (c) allowing the cast component to cool in the mould to a temperature of at least 775° C., cleaning the casting in a manner known per se.

The invention also relates to the use of the CGI alloy composition for the production of a CGI article by machining.

The machining step comprises one or more working operations selected from the group consisting of milling, drilling, tapping, honing and boring, which may be conducted with a variety of cutting materials and cutting conditions (speed, feed, depth of cut, tool geometry, tool coatings etc). Although the present CGI alloy is intended to improve all cutting operations, it is primarily effective in high speed boring and turning operations, where the cutting edge is in continuous contact with the cast alloy.

Base iron is referred to as the iron held in the furnace before Mg and inoculant is added.

DETAILED DESCRIPTION OF THE INVENTION

The production, control and fettling of the proposed high-silicon CGI alloys (Hi-Si CGI alloys) are the same as those used for conventional CGI. The only significant difference is that additional silicon, in the form of silicon carbide or ferro-silicon or any other commercial silicon source, is added to the bath either during melting or holding of molten iron. Conventional casting methods are used and the castings are allowed to cool in the sand moulds until the bulk temperature is less than 775° C. Thereafter the casting can be air cooled, cleaned and prepared for machining.

In order to make the invention easy to understand and produce, it will be described with reference to the appended Table I below.

Table I is a diagram of an embodiment of the alloy of the present invention which was melted and examined for chemical composition. In comparison to 'standard' predominantly pearlitic CGI alloys for engine block applications, the new high-silicon CGI has a ferritic matrix and is characterized by the following compositional differences.

TABLE I

Alloy made according to the present invention.

| Element | Standard CGI (%) | Hi-Si CGI (%) |
|---|---|---|
| Carbon | 3.3–3.8 | 3.2–3.8 |
| Silicon | 2.0–2.5 | 2.8–4.0 |
| Sulphur | <0.030 | <0.030 |
| Magnesium | 0.005–0.025 | 0.005–0.025 |
| Manganese | <0.5 | <0.4 |
| Copper | <1.0 | <0.2 |
| Tin | <0.1 | Trace |

The roles assumed by the various alloying components are as follows:

C: 3.2 to 3.8 weight %.

Carbon is necessary to ensure adequate graphite formation. In compacted form, the graphite particles provide good thermal conductivity and good vibration damping. The carbon content of Hi-Si CGI may be slightly reduced relative to conventional CGI to maintain a constant carbon equivalent ($CE=\epsilon+\rho_i/3$).

Si: 2.8 to 4.0 weight %.

Silicon is a very strong graphitizing agent promoting the precipitation of carbon and the growth of graphite particles. This ultimately results in a ferritic matrix. Silicon also increases the hardness of the ferrite phase. Silicon contents in excess of 2.8% are required to stabilize a predominantly ferritic matrix. The increased silicon content also increases the carbon equivalent ($CE=\epsilon+\rho_i/3$) of the iron.

S: up to 0.030 weight %.

Sulphur is a contaminant that is unavoidable in cast irons. It reacts with calcium, magnesium, rare earth metals and manganese to form harmless sulphide inclusions. The manganese sulphide inclusions improve machinability in some steels but are ineffective for this purpose in magnesium-treated cast irons.

Mg: 0.005 to 0.025 weight %.

Magnesium is intentionally added to control the growth behaviour of the graphite particles. CGI is typically stable within a range of approximately 0.008% Mg, depending on the presence of impurity elements and the cooling rate of the casting.

Mn: up to 0.4 weight %

Manganese is a common element in raw materials used to melt cast iron. It promotes pearlite formation and should therefore be reduced relative to conventional CGI. It is generally balanced with sulphur in the amount $$\% Mn=0.2*\%S+0.18$$

Cu: up to 0.2 weight %

Copper is commonly added to CGI and some ductile irons to stabilize pearlite. Additions of up to 1.0% are required to establish a predominantly pearlite matrix in CGI. Lower additions are preferred for Hi-Si CGI. The reduced copper content provides a cost reduction relative to conventional CGI.

Sn: trace

Tin is a very strong pearlite stabilizer. It is typically added together with copper (1.0% Cu and 0.1% Sn) to stabilize a fully pearlite matrix in conventional CGI. Limiting tin to "trace" amounts assists in formation of a fully ferritic Hi-Si CGI matrix. The reduced tin content provides a cost reduction relative to conventional CGI.

Specific alloys made according to the present invention are set forth in the following examples:

EXAMPLE 1

Standard 25 mm diameter test bars were produced according to compositions provided in Table I and allowed to cool to 700° C. before shake out and subsequent air cooling to room temperature. It was found that a CGI alloy comprising approximately 3.3% Si had the same Brinell hardness as a fully pearlitic conventional grey cast iron. Further tests showed that each subsequent increase of 0.1% Si provided an increase of approximately 5 Brinell hardness (5/750) points. This sensitivity between % Si and hardness allows the foundryman to achieve hardness levels specified by machinists, design engineers and material engineers. The graphite shape could be controlled within the required microstructure limits (0–20% nodularity, no flake graphite) with normal CGI process control techniques such as those taught in SE 8404579-8, SE 9003289-7 and SE 9704208-9, which are incorporated by reference. The intentional addition of titanium to assist in nodularity control was neither necessary nor desirable as titanium additions form titanium carbide and carbonitride inclusions, which significantly impair machinability.

EXAMPLE 2

During the high speed cylinder bore finishing of automotive engine blocks, cutting inserts are normally used until the flank wear reaches 0.2 or 0.3 mm. Thereafter, the insert is replaced and machining is resumed. The amount of cutting, prior to reaching the flank wear end-of-service criterion, is either measured as the number of machined bores or as the total cutting distance (at a feed rate of 0.2 mm/revolution, an 85 mm diameter and 95 mm long cylinder bore represents a total cutting distance of approximately 125 m). For normal grey iron (GG 25 according to the DIN 1691 standard) engine blocks, CBN tools are used at speeds 600–800 m/min and are expected to last for at least 200 cylinder bores or equivalently, of 25 km of total cutting distance. A comparison of typical properties and machining results for GG 25 grey iron, CGI with 'normal' silicon content and Hi-Si CGI are summarized in Tables II and III respectively.

TABLE II

Summary of materials used in comparative test

| Material Number | Type of Cast iron | Percent Pearlite | Hardness (BHN 10/3000) | Chemistry (%) C | Chemistry (%) Si |
|---|---|---|---|---|---|
| 1 | Grey | >95 | 193 | 3.18 | 2.15 |
| 2 | CGI | 80–90 | 201 | 3.73 | 2.20 |
| 3 | CGI | 90–100 | 253 | 3.64 | 2.19 |
| 4 | Hi-Si CGI | 0 | 170 | 3.55 | 3.02 |

TABLE III

Total cutting distance (km) of materials presented in Table II using CBN cutting inserts (end-of-service criteria: flank wear 0.3 mm)

| Cutting Details | | | | Cutting Distance (km) | | | |
|---|---|---|---|---|---|---|---|
| Tool Type | Speed (m/min) | Feed (mm/rev) | Depth (mm) | Material No. 1 | Material No. 2 | Material No. 3 | Material No. 4 |
| CBN | 400 | 0.3 | 0.15 | 12.5 | 4.0 | 1.5 | 55.5 |
| CBN | 800 | 0.3 | 0.15 | 22.5 | 2.0 | 1.5 | 3.0 |
| Carbide | 150 | 0.3 | 0.20 | — | 33.5 | 21.5 | 57.0 |
| Carbide | 250 | 0.3 | 0.20 | — | 5.5 | 5.5 | 27.0 |

It is apparent that from Table II that the Hi-Si CGI alloy (Material No. 4) provides substantially improved tool wear relative to conventional CGI. In comparison to GG 25 grey iron, the high-silicon variant provides, more than four times longer cutting distance when using CBN at 400 m/min. A breakeven with conventional grey cast iron is realized at speeds between 400 and 800 m/min depending on cutting conditions. For carbide tools, the Hi-Si CGI provides significant increases in tool life relative to conventional CGI.

Thus, it will be readily appreciated that the alloy of the invention can be machined into various shapes (cylinder blocks etc) with commercially acceptable tool lives and the properties of the alloy and the machining results can be controlled by the alloy composition. Accordingly, the CGI articles so produced achieve the desired microstructures and properties prior to machining, with little or no change required in the conventional machining operations for grey cast iron engine blocks.

What is claimed is:

1. A process for producing a finished article of compacted graphite iron (CGI) comprising:

providing a CGI base iron, comprising, in weight percentages, about 3.2 to 3.8 total C, 2.8 to 4.0 Si, and the balance Fe and incidental impurities;

treating, controlling and casting the CGI alloy;

allowing the casting to cool in the mould to a temperature less than or equal to 775° C.;

cleaning the casting; and machining the casting, by at least one of high speed boring, turning, milling, drilling, tapping and honing, to produce the finished article.

2. A process according to claim 1, wherein said finished article comprises a cylinder block.

3. A process according to claim 1, wherein the CGI base iron comprises, in weight percentages:

about 3.2 to 3.8 total C, 2.8 to 4.0 Si, 0.005 to 0.025 Mg, 0 to 0.030 S, 0 to 0.4 Mn, 0 to 0.2 Cu, trace Sn, and the balance Fe and incidental impurities.

4. A process according to claim 3, wherein the machining comprises a high speed boring and turning operation, in which the cutting edge is in continuous contact with the cast alloy.

5. A process according to claim 1, wherein the machining comprises a high speed boring and turning operation, in which the cutting edge is in continuous contact with the cast alloy.

6. A finished article of compacted graphite iron (CGI), the article being obtained by:

providing a CGI base iron, comprising, in weight percentages, about 3.2 to 3.8 total C, 2.8 to 4.0 Si, and the balance Fe and incidental impurities;

treating, controlling and casting the CGI alloy;

allowing the casting to cool in the mould to a temperature less than or equal to 775° C., cleaning the casting; and machining the casting, by at least one of high speed boring, turning, milling, drilling, tapping and honing, to produce the finished article.

7. A finished article of compacted graphite iron (CGI), according to claim 6, wherein the CGI base iron comprises, in weight percentages, about 3.2 to 3.8 total C, 2.8 to 4.0 Si, 0.005 to 0.025 Mg, 0 to 0.030 S, 0 to 0.4 Mn, 0 to 0.2 Cu, trace Sn, and the balance Fe and incidental impurities.

8. A process for producing a finished article of compacted graphite iron (CGI) alloy comprising:

providing a CGI base iron comprising, in weight percentages, about 3.2 to 3.8 total C, 2.8 to 4.0 Si, and the balance Fe and incidental impurities;

treating, controlling and casting the CGI alloy;

allowing the cast component to cool in the mould to a temperature less than or equal to 775° C.;

cleaning the casting; and machining the casting, by high speed boring at a speed greater than 600 m/min, to produce the finished article.

* * * * *